US008061034B2

(12) United States Patent
Mellis

(10) Patent No.: US 8,061,034 B2
(45) Date of Patent: Nov. 22, 2011

(54) METHOD FOR FORMING A BUMPER BEAM FOR A MOTOR VEHICLE

(75) Inventor: Jeffery Jay Mellis, Bloomfield Hills, MI (US)

(73) Assignee: Magna International Inc., Aurora (CA)

( * ) Notice: Subject to any disclaimer, the term of this patent is extended or adjusted under 35 U.S.C. 154(b) by 918 days.

(21) Appl. No.: 11/718,402

(22) PCT Filed: Nov. 22, 2005

(86) PCT No.: PCT/CA2005/001762
§ 371 (c)(1),
(2), (4) Date: May 2, 2007

(87) PCT Pub. No.: WO2006/056046
PCT Pub. Date: Jun. 1, 2006

(65) Prior Publication Data

US 2009/0064502 A1 Mar. 12, 2009

(51) Int. Cl.
*B21D 15/00* (2006.01)
*B21D 53/88* (2006.01)

(52) U.S. Cl. ..... 29/897.2; 72/168; 72/177

(58) Field of Classification Search ..... 29/897.2, 29/564; 52/843; 72/168, 176, 177, 181, 72/379.4; 228/146, 176
See application file for complete search history.

(56) References Cited

U.S. PATENT DOCUMENTS

| | | | | |
|---|---|---|---|---|
| 4,354,372 | A | 10/1982 | Inoue | |
| 5,395,036 | A | 3/1995 | Sturrus | |
| 5,454,504 | A | 10/1995 | Sturrus | |
| 5,566,874 | A | 10/1996 | Sturrus | |
| 5,813,594 | A | 9/1998 | Sturrus | |
| 5,934,544 | A | 8/1999 | Lee | |
| 6,360,441 | B1 | 3/2002 | Himsl | |
| 6,591,576 | B1 | 7/2003 | Iida | |
| 6,726,259 | B2 | 4/2004 | Kettler | |
| 6,813,920 | B2 | 11/2004 | Yoshida | |
| 6,820,451 | B2 | 11/2004 | Renzzulla | |
| 6,948,749 | B2 * | 9/2005 | Graber | 293/102 |
| 7,073,259 | B2 * | 7/2006 | Sundgren et al. | 29/897.35 |
| 2004/0154158 | A1 | 8/2004 | Sundgren | |

* cited by examiner

*Primary Examiner* — David Bryant
*Assistant Examiner* — Alexander P Taousakis

(57) ABSTRACT

A method for forming a bumper beam includes providing an elongated piece of sheet metal having opposing end portions and an intermediate portion, bending the end portions with respect to the intermediate portion until the end portions are substantially perpendicular to the intermediate portion, bending a central section of the intermediate portion to form a protruding bulge in the intermediate portion after the bending the end portions, and bending side sections of the intermediate portion to move ends of the end portions adjacent to one another and adjacent to the protruding bulge after the bending the central section to from the bumper beam. The end portions form front walls of the bumper beam, the protruding bulge forms inner side walls and a web portion of the bumper beam, and the side sections form outer side walls and rear walls of the bumper beam.

11 Claims, 3 Drawing Sheets

METHOD FOR FORMING A BUMPER BEAM FOR A MOTOR VEHICLE

FIELD OF THE INVENTION

The present invention relates to a bumper beam for a motor vehicle and, in particular, to the method of forming a closed section bumper beam.

BACKGROUND OF THE INVENTION

Bumper beams are made from a variety of methods, with roll forming being the most common. U.S. Pat. Nos. 6,820,451 and 6,360,441 describe roll forming techniques for forming a bumper beam having different configurations.

In U.S. Pat. Nos. 5,395,036; 5,454,504; 5,566,874; 5,813,594; 5,934,544; and 6,591,576; and United State Patent publication no. 2004/0154158, methods of forming a closed section bumper beam are disclosed.

SUMMARY OF THE INVENTION

One aspect of the invention relates to a method for forming a bumper beam for a motor vehicle. The bumper beam includes two closed sections connected together by a web portion. Each of the closed sections includes an outer side wall, an inner side wall, a rear wall that connects the outer and inner side walls, and a front wall that connects the outer and inner side walls and includes an end that overlaps and engages the web portion. The method includes providing an elongated piece of sheet metal having opposing end portions and an intermediate portion between the end portions, bending the end portions with respect to the intermediate portion until the end portions are substantially perpendicular to the intermediate portion, bending a central section of the intermediate portion to form a protruding bulge in the intermediate portion after the bending the end portions, and bending side sections of the intermediate portion on opposing sides of the protruding bulge to move ends of the opposing end portions adjacent to one another and adjacent to the protruding bulge after the bending the central section to from the bumper beam. The end portions form the front walls of the bumper beam, the protruding bulge forms the inner side wall of each closed section and the web portion of the bumper beam, and the side sections form the outer side wall and rear wall of each closed section of the bumper beam.

Another aspect of the invention relates to a method for forming a bumper beam for a motor vehicle. The bumper beam includes two closed sections connected together by a web portion. Each of the closed sections includes an outer side wall, an inner side wall, a rear wall that connects the outer and inner side walls, and a front wall that connects the outer and inner side walls and includes an end that overlaps and engages the web portion. The method includes providing an elongated piece of sheet metal, bending the sheet metal to form the front wall of each closed section of the bumper beam, bending the sheet metal to form the inner side wall of each closed section and the web portion of the bumper beam after the bending the sheet metal to form the front wall of each closed section, and bending the sheet metal to move ends of the front wall of each closed section adjacent to one another and in contact with the web portion to form the outer side wall and the rear wall of each closed section of the bumper beam after the bending the sheet metal to form the inner side wall of each closed section and the web portion of the bumper beam.

Another aspect of the invention is to provide a method of forming a beam, including: bending a substantially flat piece of sheet metal along a first bend to form a first end portion and along a second bend to form a second end portion, with an intermediate portion positioned between the first and second bends; bending a central section of the intermediate portion to form a bulge protruding from opposing, first and second side sections of the intermediate portion, the bulge being formed after the forming of the first and second bends and the first and second end portions; bending the first side section of the intermediate portion to form a third bend and bending the second side section of the intermediate portion to form a fourth bend, the third and fourth bends permitting the first and second end portions to contact the bulge and form first and second closed sections, the first closed section being separated from the second closed section by the bulge.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention In such drawings.

DETAILED DESCRIPTION OF ILLUSTRATED EMBODIMENTS

Figure 1:
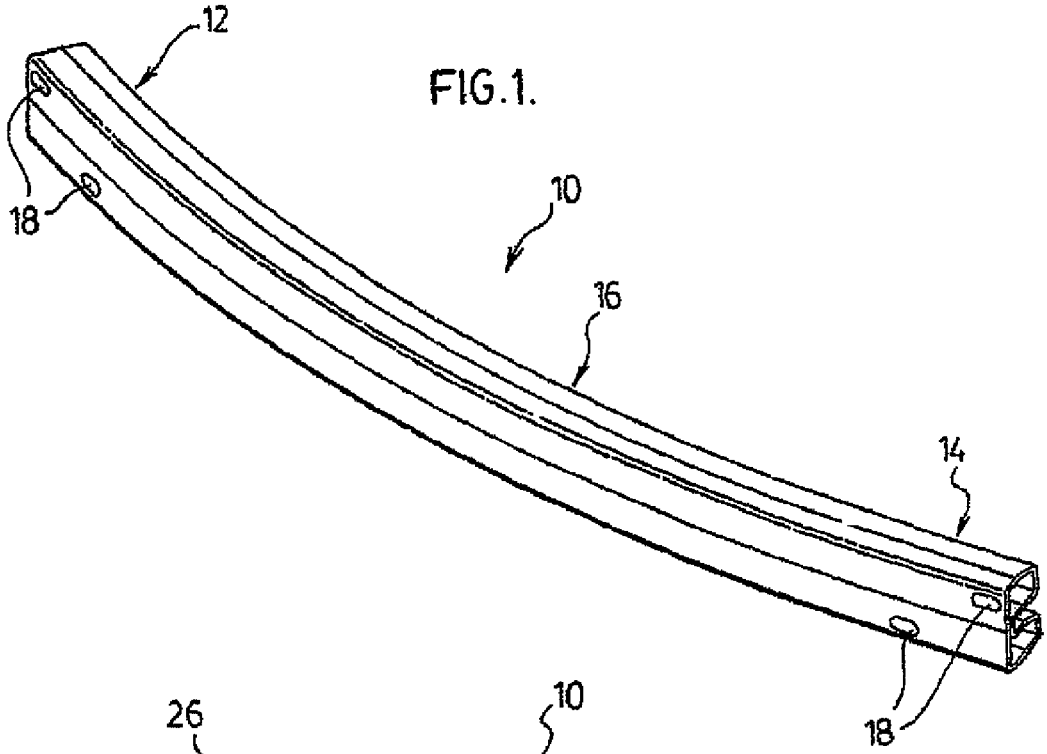
FIG. 1 is a front perspective view illustrating a bumper beam constructed in accordance with an embodiment of the invention.
Figure 2:
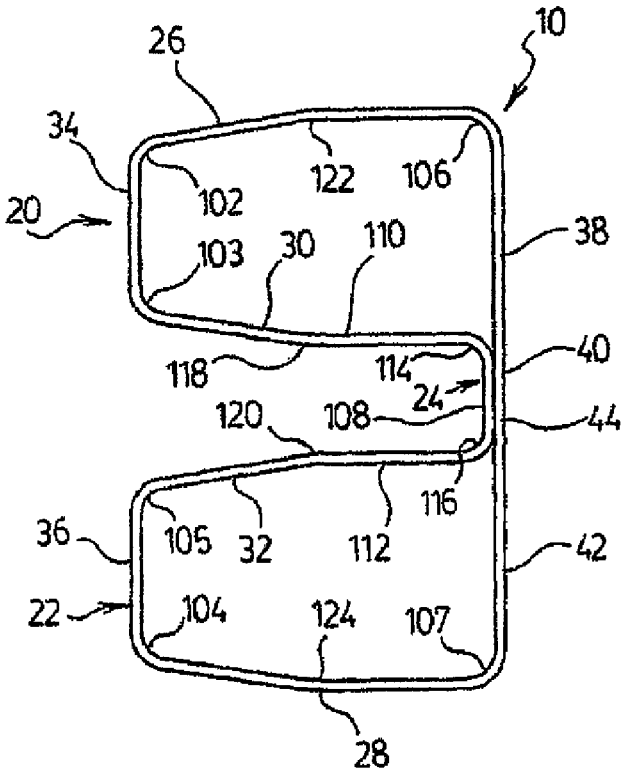
FIG. 2 is an end view illustrating the bumper beam shown in FIG. 1.

FIGS. 1-2 illustrate a bumper beam 10 for a motor vehicle constructed according to an embodiment of the present invention. The bumper beam 10 is structured to be mounted to a frame assembly of the motor vehicle at either the front end or the rear end of the motor vehicle. The bumper beam 10 may be utilized on any suitable motor vehicle. The bumper beam 10 is structured to receive collision forces during a front end or rear end collision. FIG. 2, in particular, illustrates the improved method for forming the bumper beam 10. In particular, the illustrated method includes first bending outer portions of a flat piece of sheet metal prior to bending interior portions in order to facilitate the formation of the bumper beam The bumper beam 10 is formed from an elongated piece of sheet metal, e.g., high strength steel. As will be discussed in greater detail below, the sheet metal is progressively bent into the desired shape of the bumper beam 10 by preferably a roll forming operation. However, the sheet metal may be progressively bent into the desired shape of the bumper beam 10 in any other suitable manner, e.g., a stamping operation. The sheet metal is bent to provide a one-piece bumper beam 10 with opposing end portions 12, 14 and a centrally disposed intermediate portion 16 extending between the end portions 12, 14. The sheet metal is also bent to impart a longitudinal curvature or sweep to the bumper beam 10. One example of an apparatus for forming the sweep of the bumper beam 10 is illustrated in U.S. Pat. No. 6,820,451, which is incorporated herein by reference thereto. Examples of other bumper beams are illustrated in U.S. Pat. Nos. 5,306,058, 5,395,036, 5,454, 504, 5,566,874, and 5,813,594 to Sturrus, which are all incorporated herein by reference thereto, respectively.

The bumper beam 10, which can vary in length and longitudinal curvature to suit various vehicle widths and contours, is mounted to the frame assembly of the vehicle by conventional systems, including bolting or welding each end portion 12, 14 to the frame assembly. As shown in FIG. 1, the end portions 12, 14 may include one or more openings 18 to facilitate mounting to the frame assembly.

FIG. 2 illustrates an end view of the bumper beam 10, which is consistent along its length. As illustrated, the bumper beam 10 includes two closed sections 20, 22 connected together by a web portion 24. Each closed section 20, 22 includes an outer side wall 26, 28, respectively, and an inner side wall 30, 32, respectively. A rear wall 34 connects the side walls 26, 30 of the closed section 20 at bends 102 and 103, respectively, and a rear wall 36 connects the side walls 28, 32 of the closed section 22 at bends 104 and 05, respectively. A front wall 38 connects with the side wall 26 of the closed section 20 at bond 106, and includes an extended end 40 that overlaps and engages the web portion 24. A front wall 42 connects with the side wall 28 of the closed section 22 at bend 107 and includes an extended end 44 that also overlaps and engages the web portion 24. The extended ends 40, 44 abut one another and may be rigidly secured to one another and to the web portion 24, e.g., by welding. The web portion or bulge 24 includes a top section 108 that is connected to two side sections 110 and 112 by bends 114 and 116. Web portion 24 also has an additional bend 118 and 120 in each side section 110 and 112, respectively. Also, side walls 26 and 28 may have an additional bend 122 and 124, respectively. It should be understood that the configuration illustrated in FIG. 2 is merely one embodiment of the various configurations the bumper beam 10 can form.

Figure 3:
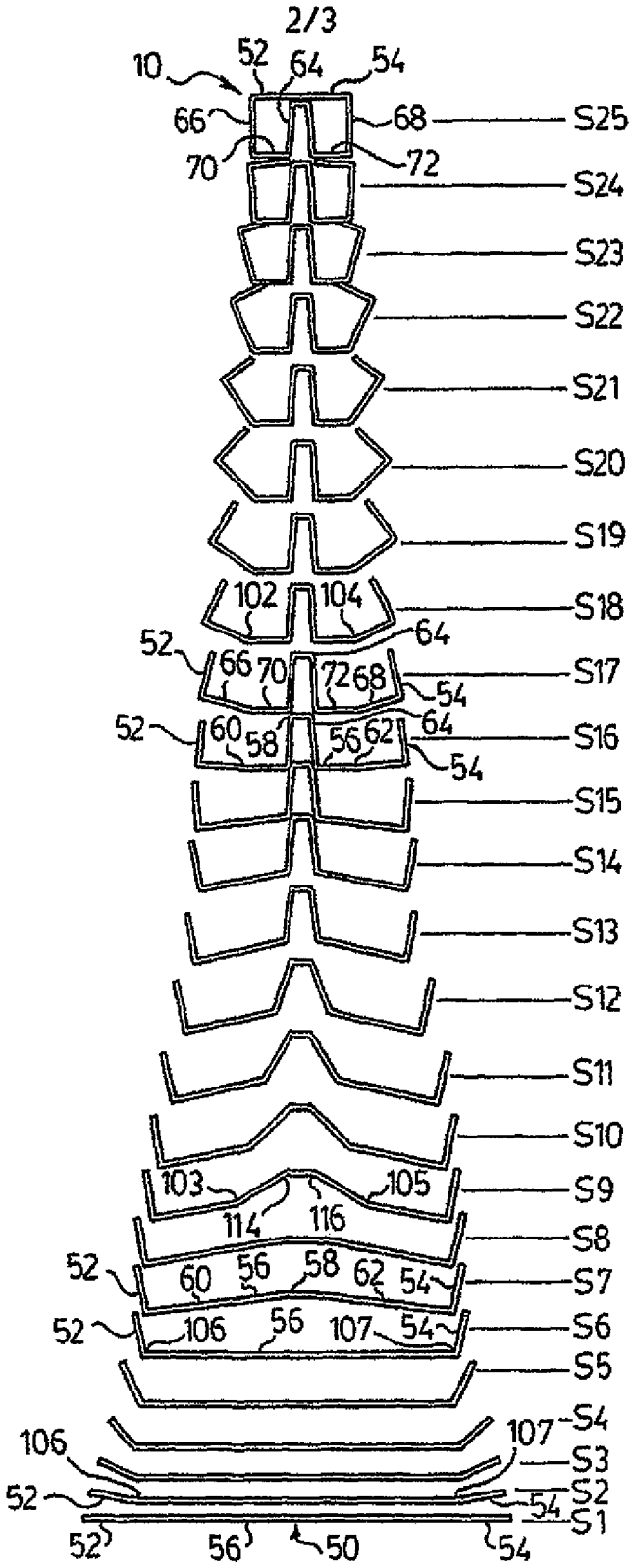
FIG. 3 is a series of views illustrating an embodiment of a method for forming the bumper beam shown in FIG. 1.

FIG. 3 illustrates the method for forming the bumper beam 10 in accordance with an embodiment of the invention. In the illustrated embodiment, the bumper beam 10 is formed by a roll forming operation wherein a series of roller assemblies progressively bend an elongated piece of sheet metal into the desired shape of the bumper beam 10. Such bending processes are disclosed in the above-incorporated U.S. patents.

As shown in FIG. 3, the steps of forming the bumper beam 10 start at with a flat sheet of material as illustrated at the bottom of FIG. 3. The bending of the sheet is illustrated with each progressive step being illustrated above the previous step. Step S1 illustrates the elongated piece of substantially flat sheet metal 50 that is initially fed into the series of roller assemblies. At steps S2 to S6, opposing end portions 52, 54 of the sheet metal are progressively bent upwardly (as viewed in FIG. 3) as the intermediate portion 56 of the sheet metal remains substantially flat. The end portions 52, 54 are progressively bent until the end portions 52, 54 are substantially perpendicular to the intermediate portion 56, as shown at step S6. The end portions 52, 54 will eventually form the front walls 38, 42 of the bumper beam 10. As seen in step S2, the bends 106 and 107 are initiated and are the first bends to occur in the flat sheet 50.

At step S6, bends 106 and 107 are not yet substantially forming right angles in that they form obtuse angles, but they are very close to their final shape. Regardless, at step S2, the extent of end portions 52 and 54 has been established by the bends 106 and 106, respectively. Thus, in step S6, bends 106 and 107 are substantially formed. Also at step S6, the rest of the sheet 50 remains substantially flat and the bulge 64 has not yet begun to form. At step S7, the intermediate portion 56 is just beginning to be bent to form bulge 64 and at step S9, bends 103, 114, 116, and 105 can be seen as they are just beginning to form.

At steps S7 to S16, a central section 58 of the intermediate portion 56 is progressively bent upwardly (as viewed in FIG. 3) as side sections 60, 62 of the intermediate portion 56 remain substantially perpendicular to the end portions 52, 54. The central section 58 is progressively bent until a protruding bulge 64 is formed in the intermediate portion 56, as shown at step S16. The protruding bulge 64 will eventually form the inner side walls 30, 32 and web portion 24 of the bumper beam 10.

At steps S17 and S18, the bends 102 and 104 are just beginning to be formed. At steps S17 to S25, portions 66, 68 of the side sections 60, 62 adjacent the end portions 52, 54 are progressively bent upwardly (as viewed in FIG. 3) as remaining portions 70, 72 of the side sections 60, 62 adjacent the protruding bulge 64 remain substantially flat. The portions 66, 68 of the side sections 60, 62 are progressively bent upwardly until the portions 66, 68 of the side sections 60, 62 are substantially perpendicular to the remaining portions 70, 72 of the side sections 60, 62, as shown at step S25. This action also moves the ends of the end portions 52, 54 adjacent to one another, e.g., into abutment, and adjacent to the protruding bulge 64, e.g., into abutment. The ends of the end portions 52, 54, which form the extended ends 40, 44, may be conjoined or rigidly secured to one another and to the protruding bulge 64, which forms the web portion 24, by such processes as welding. At step S25, which illustrates the final form of the bumper beam 10, the portions 66, 68 of the side sections 60, 62 form the outer side walls 26, 28 of the bumper beam 10, and the remaining portions 70, 72 of the side sections 60, 62 form the rear walls 34, 36 of the bumper beam 10.

Thus, the bumper beam 10 is formed by a method that includes three principal actions. The first action includes the initial bending of the end portions 52, 54 of the sheet metal that will eventually form the front walls 38, 42 of the bumper beam 10. The second action, which follows the first action, includes the forming of the protruding bulge 64 in the intermediate portion 56 of the sheet metal that will eventually form the inner side walls 30, 32 and web portion 24 of the bumper beam 10. The third action, which follows the second action, includes the bending of the intermediate portion 56 of the sheet metal so as to engage the end portions 52, 54 with one another and the protruding bulge 64 and form the outer side walls 26, 28 and rear walls 36, 38 of the bumper beam 10.

Figure 4:
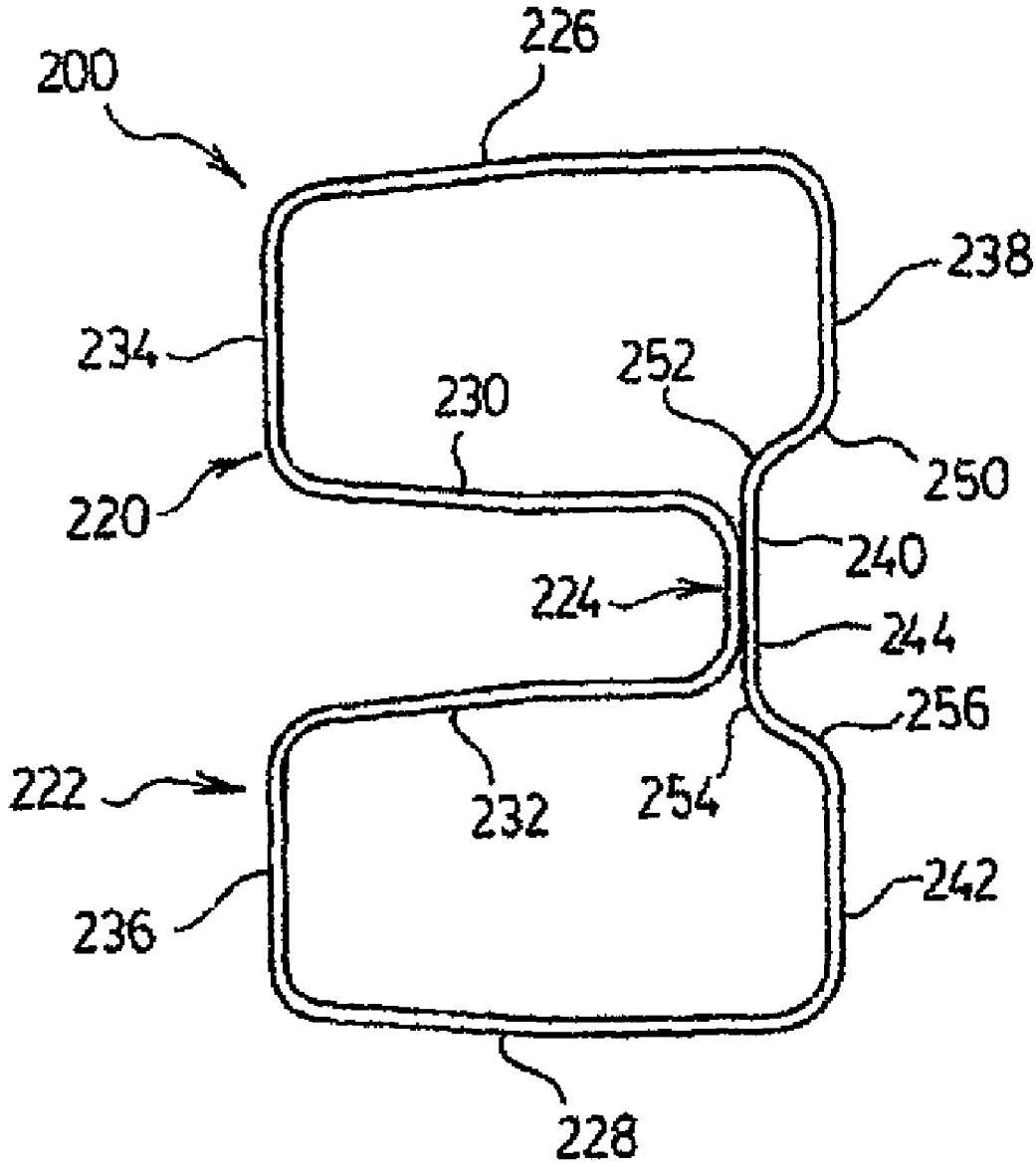
FIG. 4 is an end view of another embodiment of a bumper beam in accordance with the invention.

It should be understood that the bumper beam 10 illustrated is only exemplary, and the transverse cross-sectional configuration may be suitably varied to meet the size and safety requirements for a particular vehicle. For example, FIG. 4 illustrates another embodiment of a bumper beam 200. In this embodiment, the front walls 238, 242 of the bumper beam 260 have a different configuration. Specifically, the extended ends 240, 244 of the front walls 238, 242 are recessed such that they extend in a different plane than the remaining portion of the front walls 238, 242. Thus, four additional bends are formed, that is, bends 250 and 252 are formed between wall 238 and end 240, and bends 254 and 256 are formed between wall 242 and end 244. The remaining sections of the bumper beam 200 are substantially similar to the bumper beam 10. However, the inner side walls 230, 232 have a shorter length than the inner side walls 30, 32 in order to accommodate the recessed extended ends 240, 244.

The bumper beam 200 may be formed by a method substantially similar to the method described above for forming the bumper beam 10. In contrast, the method would be modified to include end portions 52, 54 with a longer length and a protruding bulge 64 with a smaller height. Further, additional steps would be provided for bending the end portions 52, 54 to form the recessed configuration of the extended ends 240, 244.

The foregoing specific embodiments have been provided to illustrate the structural and functional principles of the present invention, and are not intended to be limiting. To the contrary, the present invention is intended to encompass all modifications, alterations, and substitutions within the spint and scope of the appended claims.

What is claimed is:

1. A method for forming a bumper beam for a motor vehicle, the bumper beam including two closed sections connected together by a web portion, each of the closed sections including an outer side wall, an inner side wall, a rear wall that connects the outer and inner side walls, and a front wall that connects the outer and inner side walls and includes an end that overlaps and engages the web portion, the method comprising:

providing an elongated piece of sheet metal having opposing end portions and an intermediate portion between the end portions;

bending the end portions with respect to the intermediate portion until the end portions are substantially perpendicular to the intermediate portion;

bending a central section of the intermediate portion to form a protruding bulge in the intermediate portion after the bending the end portions; and bending side sections of the intermediate portion on opposing sides of the protruding bulge to move ends of the opposing end portions adjacent to one another and adjacent to the protruding bulge after the bending the central section to from the bumper beam, wherein the end portions form the front walls of the bumper beam, the protruding bulge forms the inner side wall of each closed section and the web portion of the bumper beam, and the side sections form the outer side wall and rear wall of each closed section of the bumper beam.

2. The method according to claim 1, wherein each of the bending the end portions, the bending the central section, and the bending the side sections includes bending by a roll forming operation.

3. The method according to claim 1, further comprising bending the bumper beam to impart a longitudinal curvature to the bumper beam.

4. The method according to claim 1, wherein the bending the end portions with respect to the intermediate portion includes maintaining the intermediate portion substantially flat.

5. The method according to claim 1, wherein the bending the central section of the intermediate portion to form the protruding bulge includes maintaining the side sections of the intermediate portion substantially perpendicular to the end portions.

6. The method according to claim 1, wherein the bending the side sections of the intermediate portion to move ends of the opposing end portions adjacent to one another and adjacent to the protruding bulge includes bending portions of the side sections adjacent the end portions and maintaining remaining portions of the side sections adjacent the protruding bulge substantially flat.

7. The method according to claim 6, wherein the portions of the side sections are bent until the portions of the side sections are substantially perpendicular to the remaining portions of the side sections.

8. The method according to claim 1, further comprising welding the ends of the end portions to one another and to the protruding bulge.

9. The method according to claim 1, further comprising bending the ends of the end portions such that the ends extend in a different plane than the remaining portions of the end portions.

10. A method of forming a beam, including:

bending a substantially flat piece of sheet metal along a first bend to form a first end portion and along a second bend to form a second end portion, with an intermediate portion positioned between the first and second bends;

bending a central section of the intermediate portion to form a bulge protruding from opposing, first and second side sections of the intermediate portion, the bulge being formed after the bending of the first and second bends and the forming of the first and second end portions;

bending the first side section of the intermediate portion to form a third bend and bending the second side section of the intermediate portion to form a fourth bend, the third and fourth bends permitting the first and second end portions to contact the bulge and form first and second closed sections, a greater portion of the first closed section being separated from a greater portion of the second closed section by the bulge wherein bending the first and second side sections of the intermediate portion includes bending the first and second side sections to form a single, substantially flat surface with the first and second end portions.

11. The method according to claim 10, further comprising conjoining the first and second end portions to a top section of the bulge.

* * * * *